US011180884B2

(12) United States Patent
Sans Serra

(10) Patent No.: US 11,180,884 B2
(45) Date of Patent: Nov. 23, 2021

(54) AUXILIARY POWER SOURCE FOR A WASHING MACHINE

(71) Applicant: GIRBAU, S.A., Barcelona (ES)

(72) Inventor: Jordi Sans Serra, Barcelona (ES)

( * ) Notice: Subject to any disclaimer, the term of this patent is extended or adjusted under 35 U.S.C. 154(b) by 92 days.

(21) Appl. No.: 16/776,920

(22) Filed: Jan. 30, 2020

(65) Prior Publication Data

US 2020/0248360 A1 Aug. 6, 2020

(30) Foreign Application Priority Data

Feb. 1, 2019 (EP) ..... 19382072

(51) Int. Cl.

| | |
|---|---|
| ***D06F 34/10*** | (2020.01) |
| ***D06F 103/18*** | (2020.01) |
| ***D06F 105/44*** | (2020.01) |
| ***D06F 101/20*** | (2020.01) |
| ***D06F 103/24*** | (2020.01) |
| ***D06F 105/08*** | (2020.01) |
| *D06F 105/50* | (2020.01) |

(52) U.S. Cl.

CPC ..... *D06F 34/10* (2020.02); *D06F 2101/20* (2020.02); *D06F 2103/18* (2020.02); *D06F 2103/24* (2020.02); *D06F 2105/08* (2020.02); *D06F 2105/44* (2020.02); *D06F 2105/50* (2020.02)

(58) Field of Classification Search

CPC ..... D06F 33/47; D06F 33/74; D06F 34/10; D06F 37/42; D06F 39/081

See application file for complete search history.

(56) References Cited

U.S. PATENT DOCUMENTS

| | | | | |
|---|---|---|---|---|
| 5,823,017 | A * | 10/1998 | Hapke | D06F 34/20 68/12.26 |
| 5,879,036 | A * | 3/1999 | Moline | D06F 34/10 292/210 |
| 2004/0140677 | A1* | 7/2004 | Hengelein | D06F 39/14 292/201 |
| 2007/0101512 | A1* | 5/2007 | Lee | D06F 39/081 8/158 |
| 2008/0010195 | A1* | 1/2008 | Yoo | G06Q 20/10 705/39 |

(Continued)

FOREIGN PATENT DOCUMENTS

| | | | | |
|---|---|---|---|---|
| EP | 2773803 | B1 * | 12/2015 | D06F 33/00 |
| KR | 20060085802 | A * | 7/2006 | |
| WO | WO-2014136370 | A1 * | 9/2014 | D06F 33/40 |

*Primary Examiner* — Spencer E. Bell

(74) *Attorney, Agent, or Firm* — Eugenio J. Torres-Oyola; Victor M. Rodriguez-Reyes; Rafael Rodriguez-Muriel

(57) ABSTRACT

Washing machine (1) having a method for powering it in the event of a power supply failure, wherein said washing machine (1) comprises: a drum, an opening with a water-tight door, a water inlet, at least one electronic control unit (5) and an auxiliary power source (3), wherein when the control unit (5) detects a power supply failure the washing machine (1) switches powering means from a main external power source (2) to said auxiliary power source (3) through the use of a switch (4).

The auxiliary power source (3) supplies energy to the control unit (5) for a limited amount of time in order for the control unit (5) to execute one or more sets of pre-established actions according to data obtained by different sensors (6, 7).

11 Claims, 1 Drawing Sheet

(56) References Cited

U.S. PATENT DOCUMENTS

| | | | | |
|---|---|---|---|---|
| 2014/0196508 | A1* | 7/2014 | Gelber | D06F 37/30 68/212 |
| 2014/0250951 | A1* | 9/2014 | Chen | D06F 34/10 68/139 |

* cited by examiner

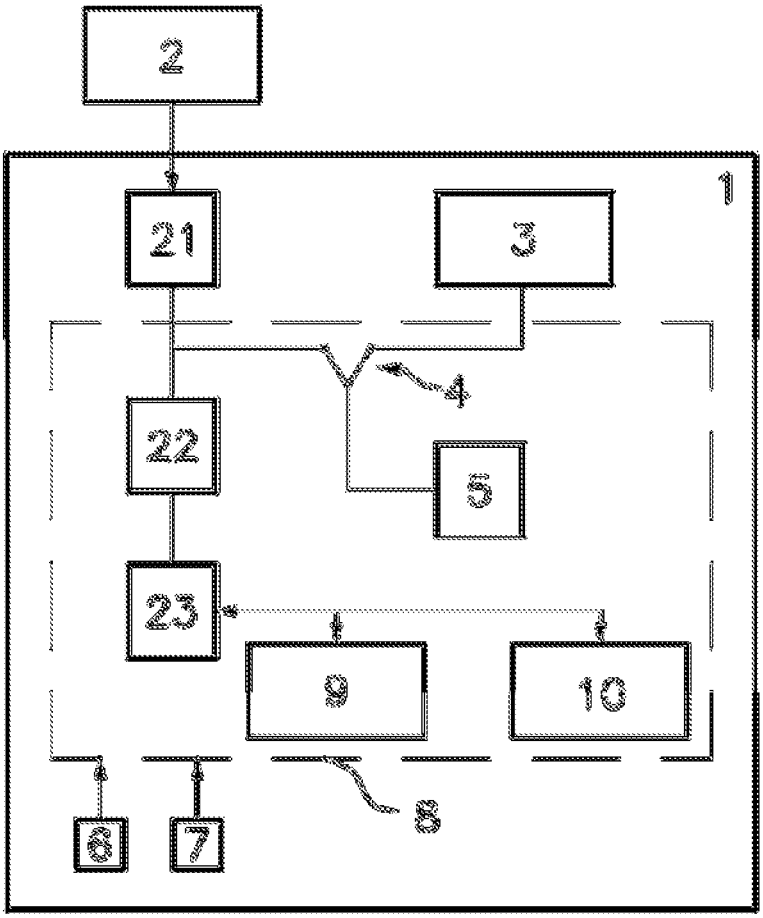
2
1
21
3
4
22
5
23
9
10
8
6
7

AUXILIARY POWER SOURCE FOR A WASHING MACHINE

TECHNICAL FIELD

The present invention refers to a household device, specifically a washing machine, including a secondary or auxiliary power source which is activated in the event of a power failure or power cut of a main external power source, in order to deactivate a washing machine in a secure and controlled manner, executing a series of prearranged steps, said steps having been defined automatically or manually by a user.

STATE OF THE ART

Nowadays household devices, such as washing machines, include safety, back-up or auxiliary mechanisms or systems that are used in the event of a power failure or malfunction of a main power source, i.e. an electric grid connection, of said household device.

An example of such a power control system can be found in granted European patent no EP 2773803, which discloses a laundry processing apparatus which includes a laundry processing drum, a driving system and a power control system. The power control system is used to supply energy to the driving system from either a power grid connected to a transformer or an electrical storage device, arranged in parallel in an electric circuit. The power control system includes a controller, electrically connected to a voltage detection module, to determine if the input voltage of the transformer detected by the voltage detection module is in a predetermined voltage range. If the voltage detected is outside said predetermined range, the controller sends a signal to a first switch in order to connect the electrical storage device to the driving system.

However, the aim of the power control system is to avoid damaging the laundry processing apparatus in the event of a power outage or due to an excessive voltage supplied by a main power source (power grid) and connecting an auxiliary power source (electric storage device) to maintain the laundry processing apparatus in an operational mode.

At no point does the cited document infer or describe a method for switching off the household device (washing machine), in a controlled manner carrying out certain pre-established actions.

Therefore, the aim of the present invention is to provide an electromechanical solution which enables a washing machine, when operational, to be deactivated in a secure and controlled manner in the event of a main power source being interrupted, due to a power-cut or other malfunction, by supplying energy from an auxiliary power source for brief time period so that an electronic control unit can carry out certain pre-established actions, preferably configured by a user.

BRIEF DESCRIPTION OF THE INVENTION

The present invention discloses a household device, specifically a washing machine, powered by an external power source. In general, a washing machine, also commonly referred to as a laundry device or washer, is made up of: a casing with an interior hollow enclosure with a rotating drum arranged inside said hollow enclosure, being driven by a driving system, such as a variable-speed motor.

The casing has an opening for inserting and removing clothes from inside said rotating drum, said opening including a water-tight door including a locking mechanism.

Furthermore, the washing machine has a controlled water inlet to allow entry of water into the hollow enclosure, at least one electronic control unit including a memory and a processor, and according to the present invention an auxiliary power source, which is used in the event of a power outage or malfunction of the main external power source.

The external power source is selected from a group comprising: an electric grid, a renewable energy power source, and is used to power and supply energy to the different components of the washing machine such as the driving means or a control panel of the washing machine.

On the other hand, the auxiliary power source comprises an electric storage device, such as one or more rechargeable batteries, which is preferably charged by the external power source when it isn't in use so that it is always at full capacity and ready to supply energy to the washing machine in the event of a power-cut or power failure of the external power source.

In a preferred embodiment of the present invention, the external power source is preferably an electric grid, whereas the auxiliary power source preferably comprises one or more rechargeable batteries, although the use of other suitable means known to an expert should be considered obvious and equivalent.

In a preferred embodiment, the auxiliary power source is charged by the external power source when the washing machine is being powered by the external power source, during normal working conditions.

The at least one electronic control unit is configured to switch powering means from said external power source to said auxiliary power source in the event of a power supply failure, and furthermore it is configured to carry out, at least, either a first set or a second set of pre-established actions according to a method stored in the memory.

When this occurs, the at least one electronic control unit of the washing machine carries out the following steps in order to turn off the washing machine in a controlled and secure manner:

i. determine if a water level is above or below a predetermined threshold value by means of a first sensor, and determining if said drum is static or in motion by means of a second sensor, wherein if said second sensor indicates that the drum is static the control unit proceeds to the following step, step ii., although if the second sensor sends a signal to the electronic control unit indicating that the drum is still currently in motion, rotating, the control unit waits until said second sensor indicates that the drum is static before proceeding to step ii.;

ii. once the rotating drum is static, the control unit automatically executes a first set of pre-established actions if the first sensor indicates that said water level is above said predetermined threshold value, or automatically executes a second set of pre-established actions if the second sensor indicates that said water level is below said predetermined threshold value;

iii. once the control unit has finished executing either one of said first or second set of pre-established actions, the washing machine is switched off; and iv. the control unit sends a signal to switch so that it modifies its, therefore switching the powering means back to the external power source, so that when a power outage or malfunction of the external power source has been resolved, the washing machine can operate under normal conditions.

Preferably, both the first and second set of pre-established actions are selected manually by a user through the use of a control panel installed in the washing machine, the actions being stored inside a memory of said control panel, and may include actions such as: block water-tight door, unblock water-tight door, drain water from inside the hollow enclosure, leave water inside the hollow enclosure, register point of a cycle in which the power supply from the main external power source has failed, amongst others.

In a preferred embodiment of the present invention, said first set of pre-established actions comprises, at least draining the water from inside the washing machine by means of a draining system, and unlocking the door of the washing machine, whereas said second set of pre-established actions comprises, at least unlocking the door of the washing machine, wherein the locking mechanism of the door is controlled by an actuator which is powered by the auxiliary power source.

In general, the first set of pre-established actions is executed when the water level inside the hollow enclosure/rotating drum is above a threshold value, and therefore the water must be drained from inside the washing machine so the water-tight door can be opened safely so that a user can remove the clothes or other garments from inside the drum.

On the other hand, the second set of pre-established actions will be executed when the water level inside the hollow enclosure/rotating drum is located inside a safe threshold value or else if the water inlet still hasn't been opened, allowing the user to open the water-tight door safely so that the clothes or other garments can be removed.

In a preferred embodiment, the first sensor is selected from a group comprising: a pressure sensor, a level sensor, or any other suitable sensor known to a person skilled in the art that can be used to determine if the water level is below or above a predefined threshold value.

In a preferred embodiment, the second sensor is selected from a group comprising: a speed sensor, a rotation sensor, or any other suitable sensor known to a person skilled in the art that can be used to determine if the drum is still currently in motion and therefore is still rotating.

It will also be understood that any range of values given may not be optimal in extreme values and may require adaptations of the invention to these extreme values are applicable, such adaptations being within reach of a skilled person.

Other features of the invention appear from the following detailed description of an embodiment.

BRIEF DESCRIPTION OF THE FIGURES

The foregoing and other advantages and features will be more fully understood from the following detailed description of an embodiment with reference to the accompanying drawing or drawings, to be taken in an illustrative and non-limitative manner, in which:

FIG. 1 illustrates a schematic representation of the main components which intervene in the method previously disclosed.

DETAILED DESCRIPTION OF AN EMBODIMENT

The drawing shown in FIG. 1 illustrates a schematic representation of the main components which interact inside the washing machine 1, forming an electric network or circuit, to which both the external power source 2 and the auxiliary power source 3 are connected to, in a preferred embodiment parallel to one another. The electric circuit further includes a switch 4, in charge of establishing either the external power source 2 or the auxiliary power source 3 as the power source of the washing machine 1. Under ordinary circumstances, the switch 4 is connected to the main external power source 2, however in the event of a power outage or other malfunctions, the switch 4 can be configured to either automatically switch to the auxiliary power source 3 or wait until the control unit 5 sends a signal to the switch 4 so that it can switch to the auxiliary power source 3.

The main external power source 2, preferably an electric grid, is connected to an AC/DC power converter 21 to transform AC power into DC power in order to supply power to the control unit 5 of the washing machine. The AC/DC power converter 21 is connected, in turn, to a voltage level detection unit 22 in order to monitor, in real time, electrical values used to power the washing machine 1 from the external main power source 2. The voltage level detection unit 22 is connected to a power supply manager 23 which is in charge of determining when a draining system 9 must be activated and/or when an electromechanical lock 10 must be activated in order to allow a user to open the water-tight door and access the interior of the washing machine 1, according to hardware and software installed therein, when the washing machine 1 is working under normal conditions with energy being supplied by the main external power source 2.

In the event of a power outage, the switch 4 automatically connects the auxiliary power source 3 which supplies power to the control unit 5 of the washing machine 1 for a limited amount of time, so that it can perform certain pre-established actions according to data collected by a first level sensor 6, used to determine the amount of water inside a hollow enclosure 8 of the washing machine 1 which encapsulates the drum, and a second rotation sensor 7, used to determine if the rotating drum is still in motion.

In a preferred embodiment, a memory of the control unit 5 includes two sets of pre-established actions: a first set of pre-established actions which includes draining the water from inside the hollow enclosure 8 of the washing machine 1 by means of a draining system 9, due to data sent from the level sensor 6 to the control unit 5 indicating that the amount of water inside the hollow enclosure 2 is above a predetermined threshold value, and then proceeding to unlock the door of the washing machine 1, which is preferably an electromechanical lock 10, whereas a second set of pre-established actions includes unlocking the door of the washing machine 1 without the need to drain the water from inside the hollow enclosure 2 of the washing machine 1, as it is either empty or the water level is below a predetermined threshold value.

It will be understood that various parts of one embodiment of the invention can be freely combined with parts described in other embodiments, even being said combination not explicitly described, provided there is no harm in such combination.

The invention claimed is:

1. Method for powering a washing machine, in the event of a power supply failure, wherein said washing machine comprises:

a drum within a hollow enclosure, an opening in said enclosure for inserting and removing clothes from inside said drum, said opening including a water-tight door with a locking mechanism, a water inlet, at least one electronic control unit including a memory and a processor, and an auxiliary power source, wherein when said at least one electronic control unit detects a power supply failure the washing machine switches powering means from a main external power source to said auxiliary power source through the use of a switch, and wherein when the auxiliary power source is activated, the at least one electronic control unit of the washing machine carries out the following steps:

i. determining if a water level is above or below a predetermined threshold value by means of a first sensor, and further determining if said drum is static or in motion by means of a second sensor, wherein if the drum is static the control unit proceeds to step ii., and wherein if the drum is in motion, the control unit waits until said second sensor indicates that the drum is static before proceeding to step ii., ii. automatically executing a first set of pre-established actions if said water level is above said predetermined threshold value, or automatically executing a second set of pre-established actions if said water level is below said predetermined threshold value, and iii. switching off the washing machine once the control unit has finished executing either one of said first or second set of pre-established actions, and iv. switching said powering means back to the external power source, wherein said first and second set of pre-established actions are selected manually by a user through a control panel of the washing machine.

2. Method for powering a washing machine according to claim 1, wherein said first set of pre-established actions comprises, at least, draining the water from inside the washing machine by means of a draining system, and unlocking the door of the washing machine.

3. Method for powering a washing machine according to claim 1, wherein said second set of pre-established actions comprises, at least, unlocking the door of the washing machine.

4. Method for powering a washing machine according to claim 1, wherein in step ii., said locking mechanism of the door is an electromechanical lock powered by the auxiliary power source.

5. Method for powering a washing machine according to claim 1, wherein said auxiliary power source is charged by said external power source when the washing machine is powered by the external power source.

6. Method for powering a washing machine according to claim 1, wherein said auxiliary power source comprises one or more rechargeable batteries.

7. Method for powering a washing machine according to claim 1, wherein said first sensor is selected from a group comprising a pressure sensor and a level sensor.

8. Method for powering a washing machine according to claim 1, wherein said second sensor is selected from a group comprising a speed sensor and a rotation sensor.

9. Washing machine with an auxiliary power source comprising:

a drum, a water-tight door in order to insert and remove clothes from inside said drum including a locking mechanism, an external power source, a water inlet, a draining system, and a control panel including a control unit, a memory and a processor, wherein said control unit is configured to switch powering means from said external power source to said auxiliary power source in the event of a power supply failure, and wherein the control unit is configured to carry out either a first set or a second set of pre-established actions by performing the following steps:

i. determining if a water level is above or below a predetermined threshold value by means of a first sensor, and further determining if said drum is static or in motion by means of a second sensor, wherein if the drum is static the control unit proceeds to step ii., and wherein if the drum is in motion, the control unit waits until said second sensor indicates that the drum is static before proceeding to step ii., ii. automatically executing a first set of pre-established actions if said water level is above said predetermined threshold value, or automatically executing a second set of pre-established actions if said water level is below said predetermined threshold value, and iii. switching off the washing machine once the control unit has finished executing either one of said first or second set of pre-established actions, and iv. switching said powering means back to the external power source, wherein said first and second set of pre-established actions are selected manually by a user through a control panel of the washing machine.

10. Washing machine according to claim 9, wherein said external power source is selected from a group comprising an electric grid and a renewable energy power source.

11. Washing machine according to claim 9, wherein said auxiliary power source comprises one or more rechargeable batteries.

* * * * *